US008256061B2

(12) United States Patent
Wilmo et al.

(10) Patent No.: US 8,256,061 B2
(45) Date of Patent: Sep. 4, 2012

(54) FILTER SHAKER ASSEMBLY FOR SWEEPING MACHINE

(75) Inventors: Michael Stewart Wilmo, Plymouth, MN (US); Michael Thomas Basham, Maple Grove, MN (US); Michael Shawn Ardito, Circle Pines, MN (US); Richard W. Wellens, Minneapolis, MN (US)

(73) Assignee: Tennant Company, Minneapolis, MN (US)

( * ) Notice: Subject to any disclaimer, the term of this patent is extended or adjusted under 35 U.S.C. 154(b) by 673 days.

(21) Appl. No.: 12/396,398

(22) Filed: Mar. 2, 2009

(65) Prior Publication Data

US 2009/0217479 A1 Sep. 3, 2009

Related U.S. Application Data

(60) Provisional application No. 61/032,880, filed on Feb. 29, 2008.

(51) Int. Cl.

| | |
|---|---|
| ***A47L 9/10*** | (2006.01) |
| ***A47L 9/20*** | (2006.01) |
| ***B01F 11/00*** | (2006.01) |

(52) U.S. Cl. ..... 15/352; 15/347; 366/128

(58) Field of Classification Search ..... 74/61, 87; 366/128; 15/352

See application file for complete search history.

(56) References Cited

U.S. PATENT DOCUMENTS

| | | | | |
|---|---|---|---|---|
| 2,437,034 | A * | 3/1948 | Meinzer | 451/356 |
| 2,543,342 | A * | 2/1951 | Timm | 55/283 |
| 3,320,725 | A * | 5/1967 | Foster | 55/283 |
| 4,007,026 | A * | 2/1977 | Groh | 55/302 |
| 4,032,307 | A | 6/1977 | Sommerfeld | |
| 4,510,815 | A * | 4/1985 | Baumers et al. | 74/61 |
| 4,704,144 | A | 11/1987 | LeBlanc et al. | |
| 4,970,004 | A | 11/1990 | Rosaen | |
| 5,013,333 | A * | 5/1991 | Beaufoy et al. | 95/20 |
| 5,223,005 | A | 6/1993 | Avondoglio | |
| 5,295,602 | A * | 3/1994 | Swanson | 220/786 |
| 5,303,448 | A | 4/1994 | Hennessey et al. | |
| 5,605,554 | A * | 2/1997 | Kennedy | 55/493 |
| 5,647,093 | A * | 7/1997 | Engel et al. | 15/352 |
| 6,742,219 | B2 * | 6/2004 | Lenzmeier et al. | 15/345 |

OTHER PUBLICATIONS

International Search Report and Written Opinion of the International Searching Authority, mailed Apr. 24, 2009, for PCT/US2009/035769.

International Preliminary Reporton Patentability for PCT/US2009/035769, mailed Sep. 10, 2010.

* cited by examiner

*Primary Examiner* — Bryan R Muller

(74) *Attorney, Agent, or Firm* — Briggs and Morgan, P.A.

(57) ABSTRACT

A filter shaking assembly for a floor surface maintenance machine including a filter assembly in fluid communication with the debris hopper and having a cylindrical filter held against a shaker plate. The shaker plate is vibrated by a shaker motor at least partially positioned within an interior of the filter and eccentric mass to remove an accumulation of debris from the surface of the filter. The eccentric mass may include two eccentric masses positioned on a common shaft of the shaker motor.

13 Claims, 16 Drawing Sheets

FILTER SHAKER ASSEMBLY FOR SWEEPING MACHINE

RELATED APPLICATIONS

This application claims the benefit of priority of U.S. Ser. No. 61/032,880, filed Feb. 29, 2008, which is hereby incorporated by reference in its entirety.

TECHNICAL FIELD

The present disclosure is generally directed to filtration systems for a mobile surface maintenance machine. More specifically, the present disclosure is directed to a filtration system utilizing a filter shaker assembly for periodically removing debris from a filter surface.

BRIEF SUMMARY OF THE INVENTION

The present invention is directed to a filtration system for a mobile surface maintenance machine utilizing a filter shaker for periodically removing debris from a filter surface. The filtration system is preferably vacuum-based. In one embodiment, a filter stage is provided along with a debris hopper to allow dust and debris to be removed from a filter surface via activation of a filter shaker. Loosened dust and debris is deposited within the debris hopper. A preferred form of the invention utilizes a cylindrical pleated media filter.

A conventional forward throw cylindrical broom sweeper will be used by way of example in the following description of the invention. However, it should be understood that, as already stated, the invention could as well be applied to other types of mobile surface maintenance machines, such as, for example, other types of cylindrical broom sweepers and other machines such as sacrificers and various types of vacuum sweepers.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
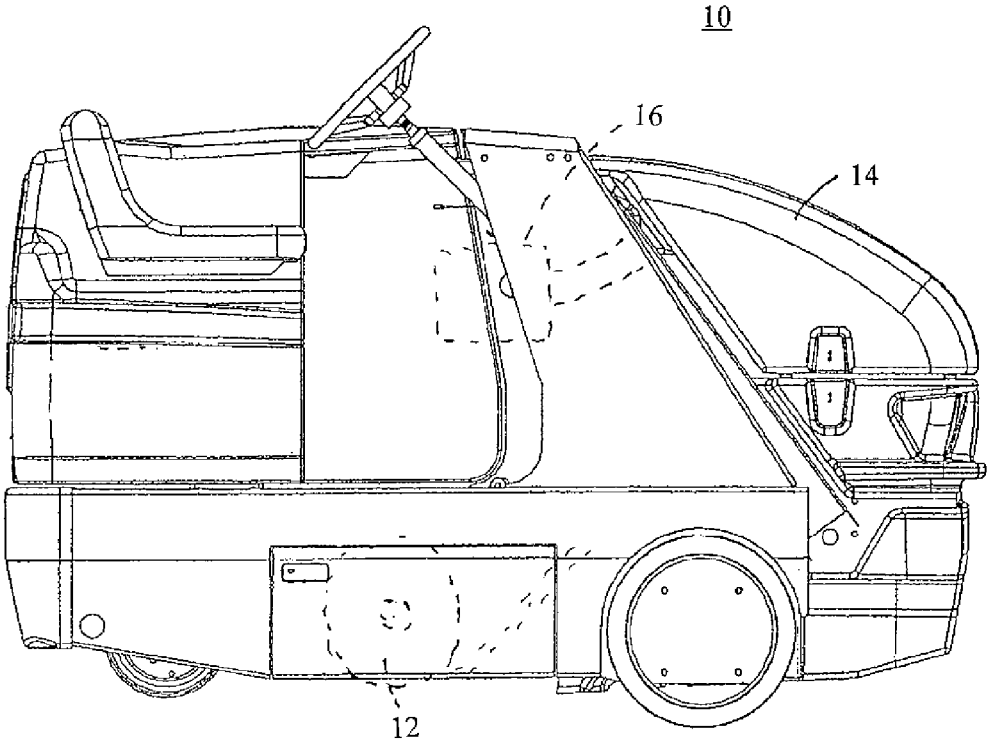
FIG. 1 is a perspective illustration of one embodiment of a cleaning machine utilizing a filter cleaning system in accordance with the present invention.

With reference to FIG. 1, there is shown an industrial sweeping machine 10. As shown, it is a forward throw sweeper. However, it could as well be an over-the-top, rear hopper sweeper, a type which is also well known in the art. It has a rotating cylindrical brush 12 for sweeping debris from a floor or other surface into a debris hopper assembly 14. Hopper arms (not shown) allow hopper assembly 14 to be lifted during a dumping procedure. The broom chamber may be enclosed by skirts which come down nearly to the floor. The skirts largely contain within the broom chamber any dust stirred up by the broom. To complete the dust control there is a suction blower or vacuum fan 16 which exhausts air from the broom chamber to the atmosphere. Prior to exhaust, the air passes through hopper assembly 14 containing a filter module. Vacuum fan 16 maintains a sub-atmospheric pressure within the broom chamber so that air is drawn in under the skirts and through the filter module prior to exhaust. As a result, relatively little dust escapes from the broom chamber to the external environment. Various components of machine 10 have been left out of FIG. 1, e.g., the drive engine and engine have been omitted to improve understanding of the aspects of the present invention. Additional aspects of machine 10 are disclosed in U.S. Pat. No. 5,940,928, said patent being incorporated by reference herein.

Figure 2:
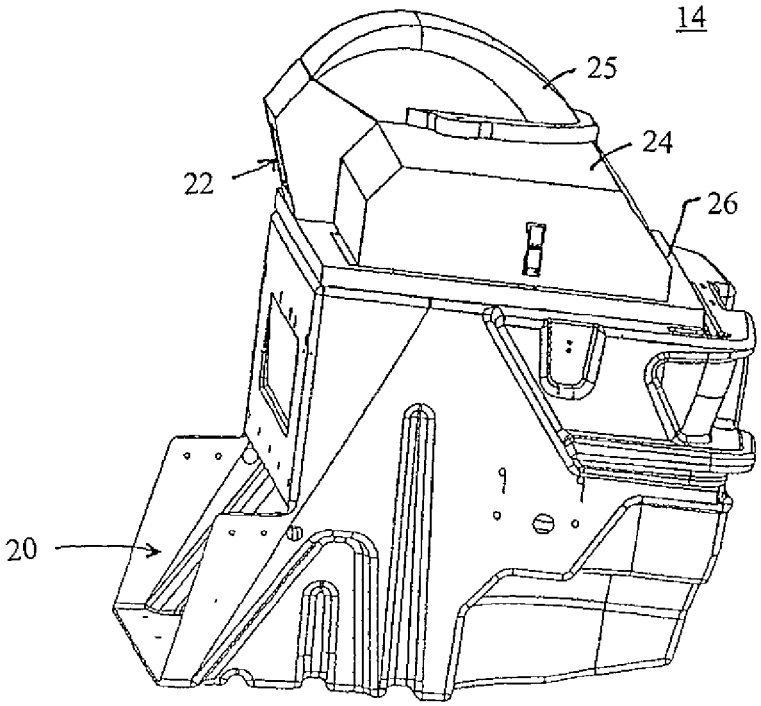
FIG. 2 is a perspective illustration of a hopper assembly and filter box of the cleaning machine of FIG. 1.

As shown in FIG. 2, hopper assembly 14 of machine 10 includes air/debris inlet 20 through which air-entrained dust and debris enters via a mechanical throwing action by brush 12 and a vacuum action generated by vacuum fan 16 during a sweeping operation of machine 10. Hopper assembly includes air outlet 22 through which filtered air is drawn by operation of vacuum fan 16. During a hopper dumping procedure, dust and debris within hopper assembly 14 exits debris inlet 20. Attached to hopper assembly 14 is a filter module including main cover 24, filter cover 25 and tray 26.

Figure 3:
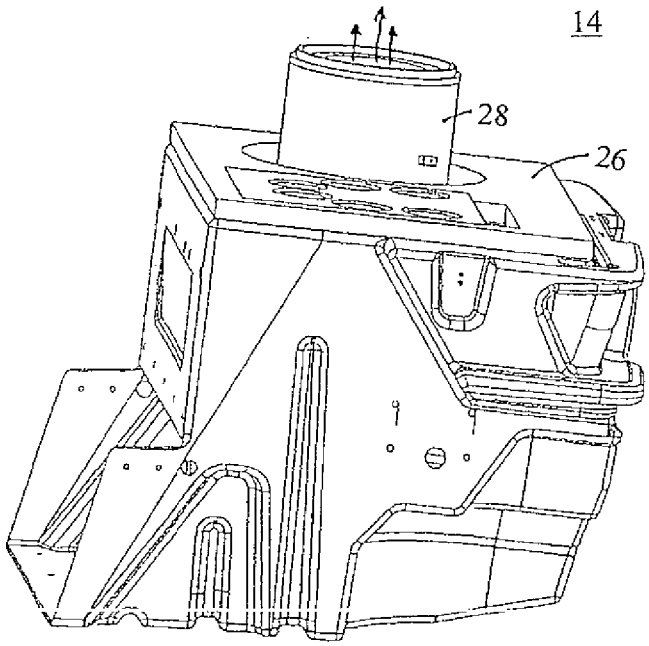
FIG. 3 is a perspective illustration of a hopper assembly and filter box of the cleaning machine of FIG. 1.

FIG. 3 depicts the hopper assembly of FIG. 2 with main cover 24 and filter cover 25 removed. A portion of cylindrical filter 28 is exposed. Dust is retained on outer surfaces of filter 28 as air is drawn toward the filter's center by action of vacuum fan 16. Air at the center of filter 28 is then directed out of air outlet 22 of filter cover 25 and toward vacuum fan 16.

Figure 4:
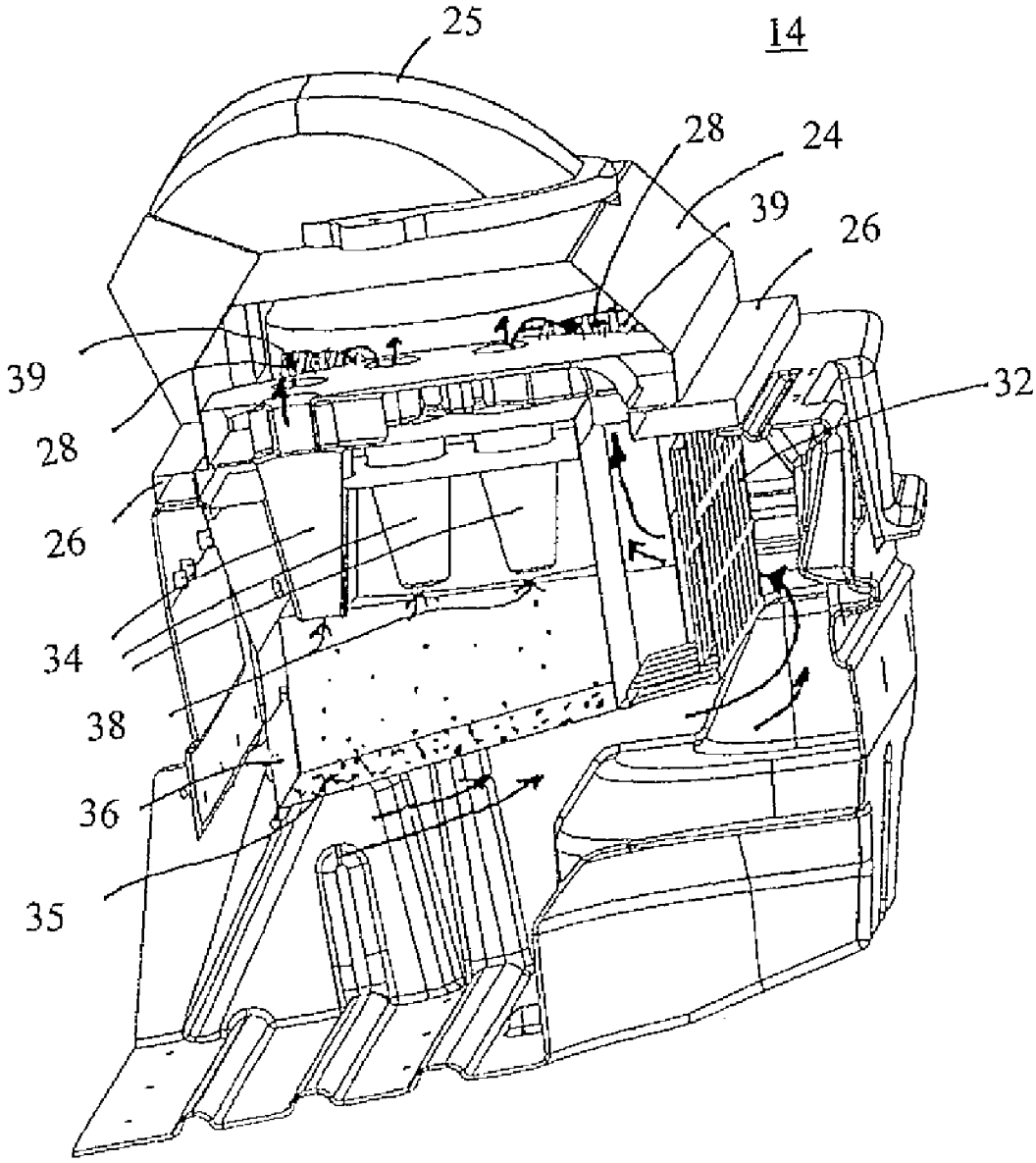
FIG. 4 illustrates a cross-sectional view of the hopper assembly and filter box of FIG. 2.

FIG. 4 is a cross-sectional view of hopper assembly 14 of FIG. 2. In the illustrated embodiment, a filter module includes three different filter sections for removing dust and debris from an air stream, namely prefilter 32, cyclonic filters/vortex separators 34 and a cylindrical filter 28. The arrows in FIG. 4 generally depict air flow through hopper assembly 14 during machine operation. This filter system removes dust from the air stream so the vacuum fan will exhaust relatively clean air to the atmosphere. The filter module includes a bank of cyclonic filters 34 through which dusty air passes causing separation and retention of at least some of the larger dust particles and debris. Dust and debris exiting the bottom apertures of cyclonic filters 34 is deposited on collection surface 35 of the filter module. During a sweeping operation, dust and debris remains on surface 35 as an outlet is sealed by flexible seal 36 by way of vacuum action. Dust and debris on surface 35 is periodically removed during a hopper dumping procedure. During such a procedure, with the vacuum fan 16 uncoupled to hopper assembly 14, seal 36 is free to swing open allowing dust and debris to pass through the outlet previously blocked by seal 36.

During machine operation, air enters the filter module through prefilters 32 and passes through the vortex separators 34 prior to being filtered by the cylindrical filter. A vortex is created by the channels and conical sections below the channels as air spirals in a path moving downward and inward, then upward in a helical path to exit at an upper opening. The centrifugal acceleration due to rapid rotation of the air causes dense particles to be forced outward to the wall of the cones of vortex separators 34. The dense particles are transported in a slow moving boundary layer downward toward the apex openings 38. During operation, air passes from vortex separators 34 through openings 39 to the cylindrical filter for subsequent filtering.

Figure 5:
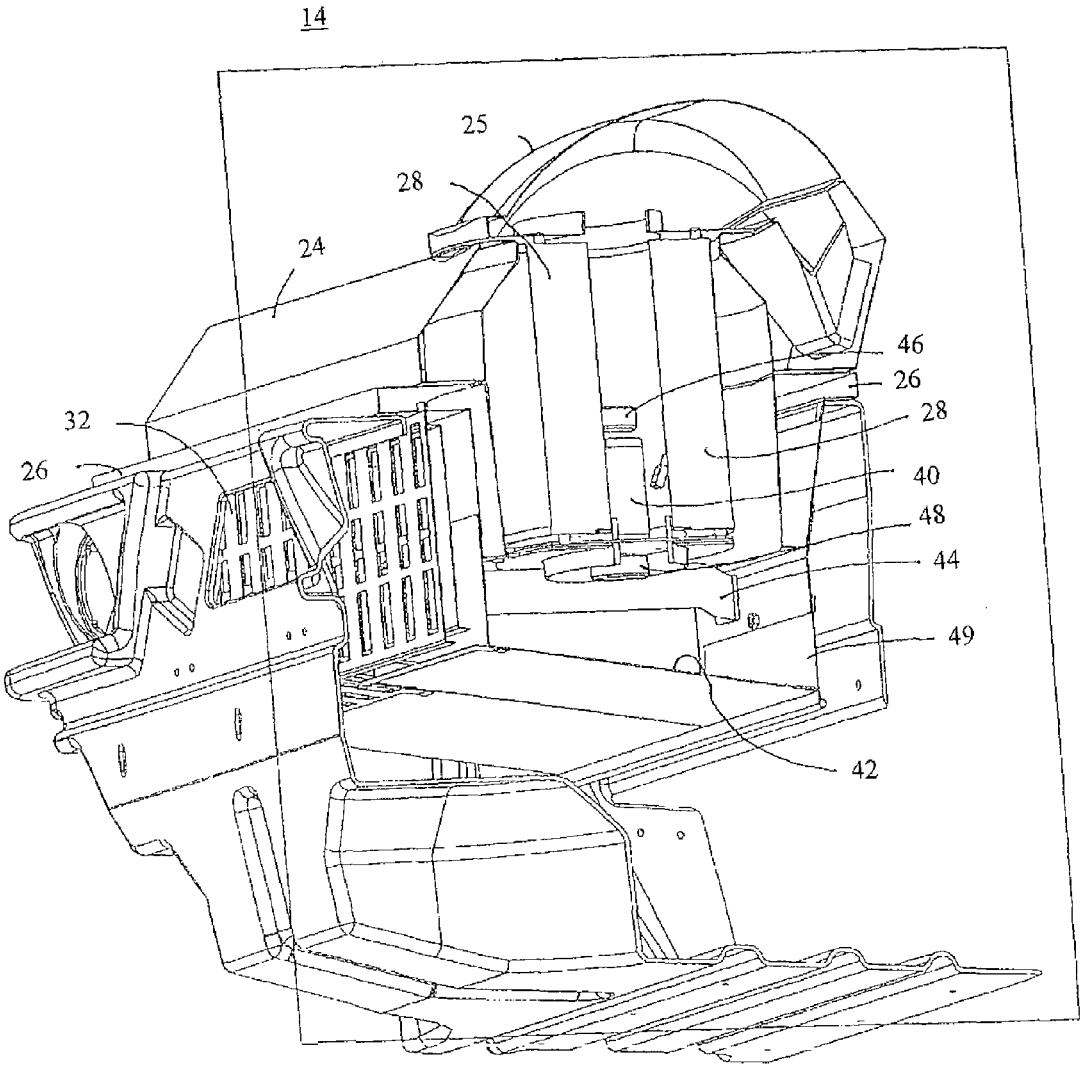
FIG. 5 illustrates a cross-sectional view of the hopper assembly and filter box of FIG. 2.

FIG. 5 is another cross-sectional view of hopper assembly 14. Cylindrical filter 28 is shown in cross section with a shaker motor 40 positioned within the central open interior of filter 28. Filter 28 and shaker motor 40 are supported above collection surface 42 by support frame 44. Shaker motor 40 is coupled to a pair of eccentric masses 46, 48 which are periodically rotated by motor 40 to impart a shaking action to filter 28. Dust and debris removed from outer surfaces of filter 28 via a filter shaking procedure drops onto collection surface 42. During a sweeping operation, flexible seal 49 is held closed by vacuum action thereby retaining debris on collection surface 42. During a hopper dumping procedure with vacuum fan 16 uncoupled, flexible seal 49 opens to release debris on collection surface 42 for passage out of hopper assembly 14 at inlet opening 20.

In one preferred embodiment of the invention, cylindrical filter 28 includes a pleated media filter, such as are manufactured, for example, by Donaldson Company, Inc. of Minneapolis, Minn. In one embodiment, filter 28 has a pleated media, with the pleats running parallel to the centerline of the cylinder, which makes them vertical when installed as shown. The pleated media is surrounded with a perforated metal sleeve for structural integrity. Outside the metal sleeve may be provided a fine mesh sleeve (not shown) woven from a slippery synthetic filament which stops the coarser dust and sheds it easily during a filter cleaning cycle. Other types of filter technologies may be applicable for implementation within filter 28.

Figure 6:
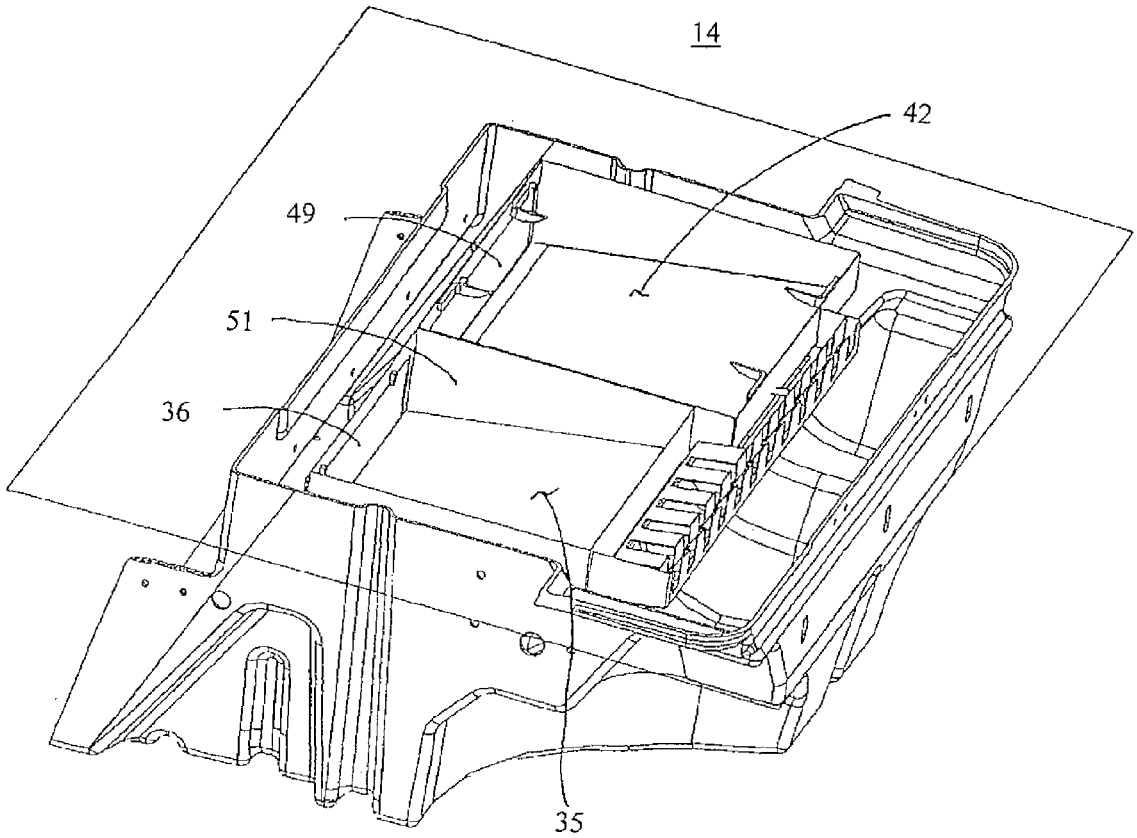
FIG. 6 illustrates a cross-sectional view of the hopper assembly and filter box of FIG. 2.

FIG. 6 is a cross-sectional view of hopper assembly components. Flexible seals 36, 49 are shown in this drawing. Collection surface 35 is separated from collection surface 42 by wall 51. A pressure differential may exist across wall 51 as pressure within the vortex separator section may be different than pressure within the cylindrical filter section.

Figure 7:
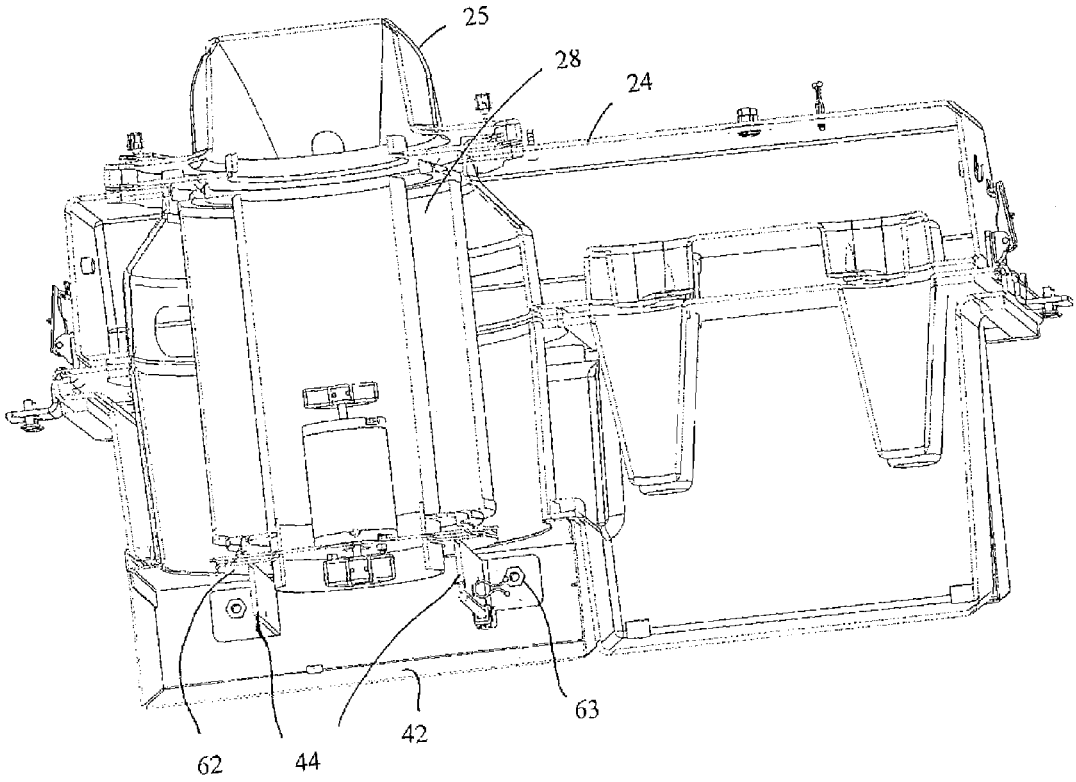
FIG. 7 illustrates a cross-sectional view of the hopper assembly and filter box of FIG. 2.

FIG. 7 depicts cylindrical filter 28 held between filter cover 25 and a filter support frame 44 above debris collection surface 42. The filter support frame 44 includes a pair of frame arms attached to base 62. The filter support frame 44 is secured via fasteners 63 passing through frame arm ends to a rigid portion of the hopper assembly. As a result, the filter support frame 44 is substantially secured against movement within the hopper assembly 14.

Figure 8:
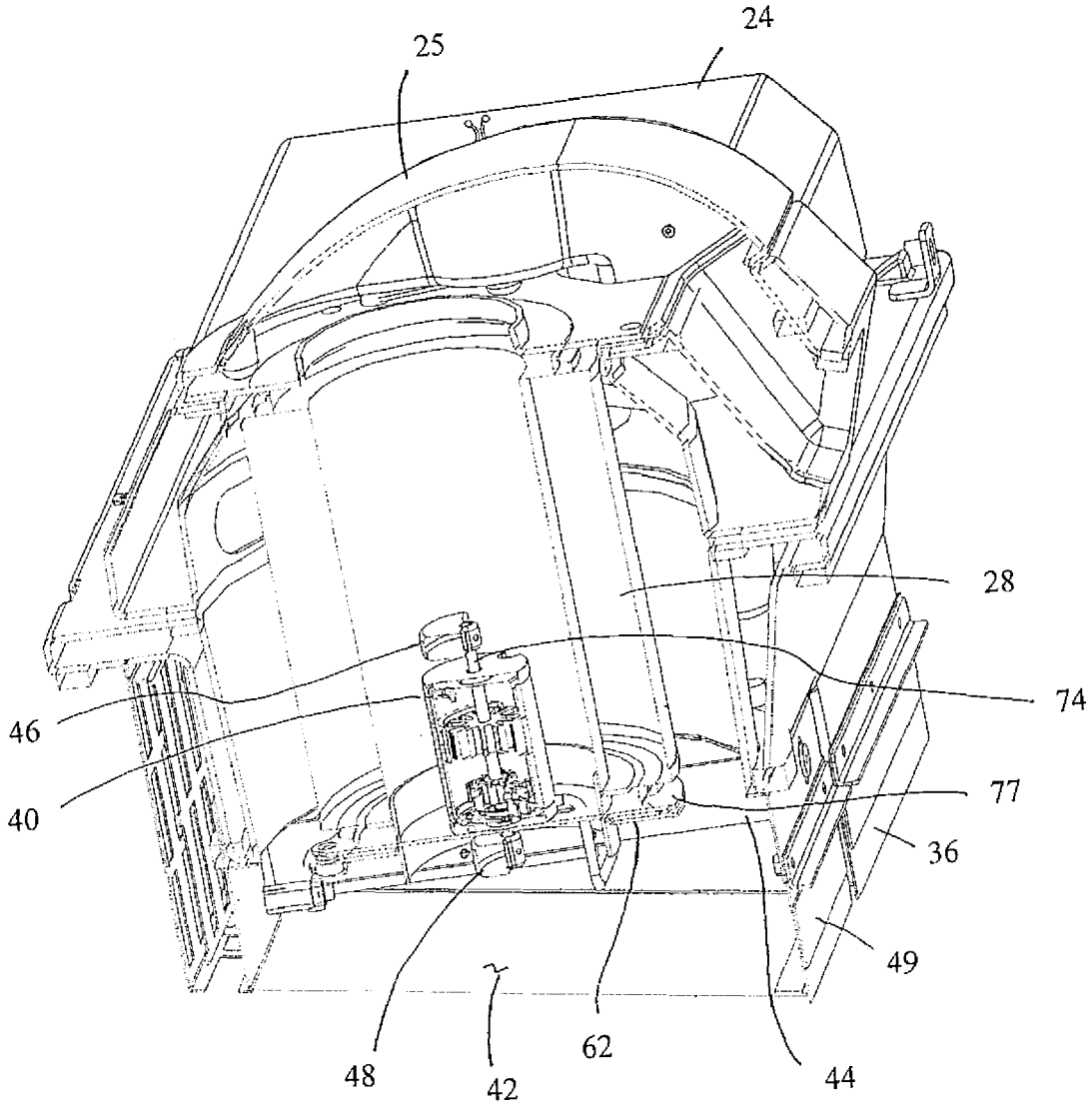
FIG. 8 illustrates a cross-sectional view of the hopper assembly and filter box of FIG. 2.
Figure 9:
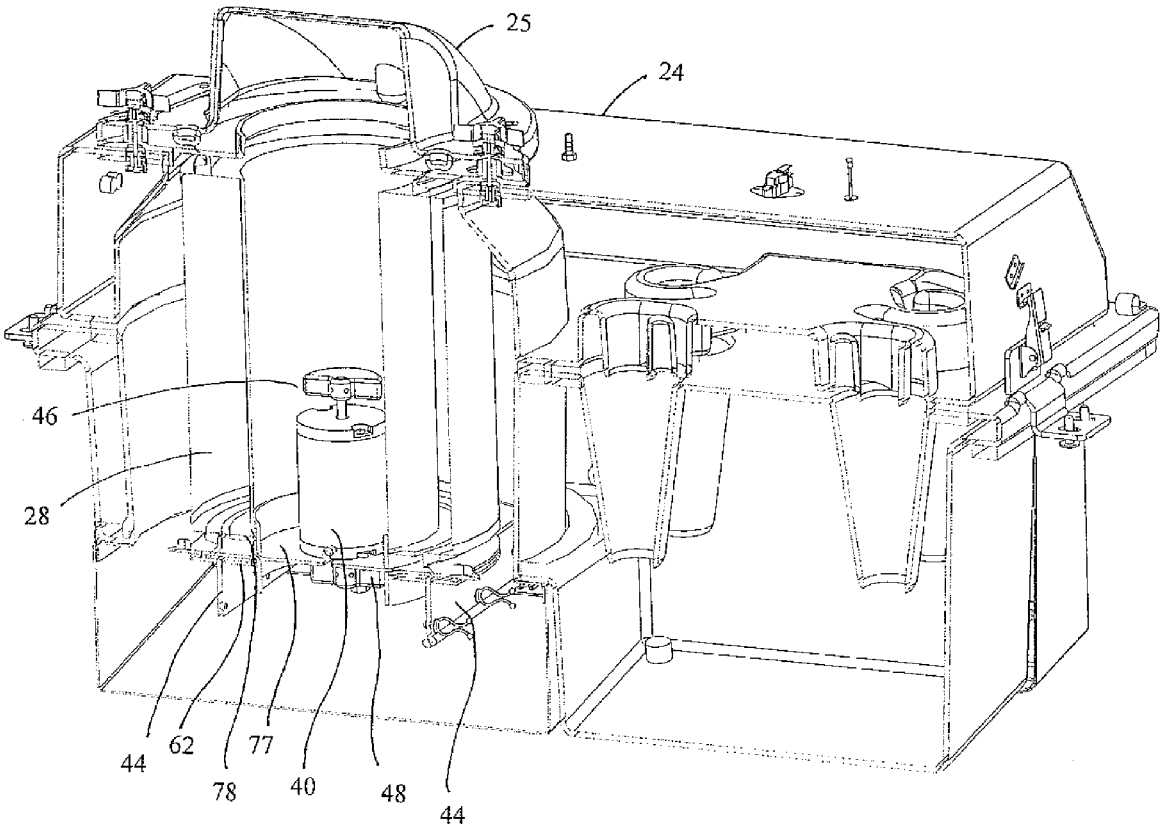
FIG. 9 illustrates a cross-sectional view of the hopper assembly and filter box of FIG. 2.

FIGS. 8 and 9 are cross sectional views of filter 28, shaker mechanism components and the filter support frame 44. Shaker mechanism includes a pair of eccentric masses 46, 48 mounted to shaft 74 of motor 40. Motor 40 may be electric or hydraulic-based. Motor 40 is secured to shaker plate 77 via, for example, threaded fasteners. Upon activation of motor 40, the weights 46, 48 rotate and vibrate shaker plate 77 and filter 28 at a frequency dependent on motor speed. In a preferred embodiment of the invention, an electric motor 40 is entirely received within a center cavity of cylindrical filter 28. As shown in FIG. 9, shaker plate 77 includes filter support 78 which engages a bottom surface of filter 28 and limits a degree of gasket compression as described in more detail below.

Figure 10:
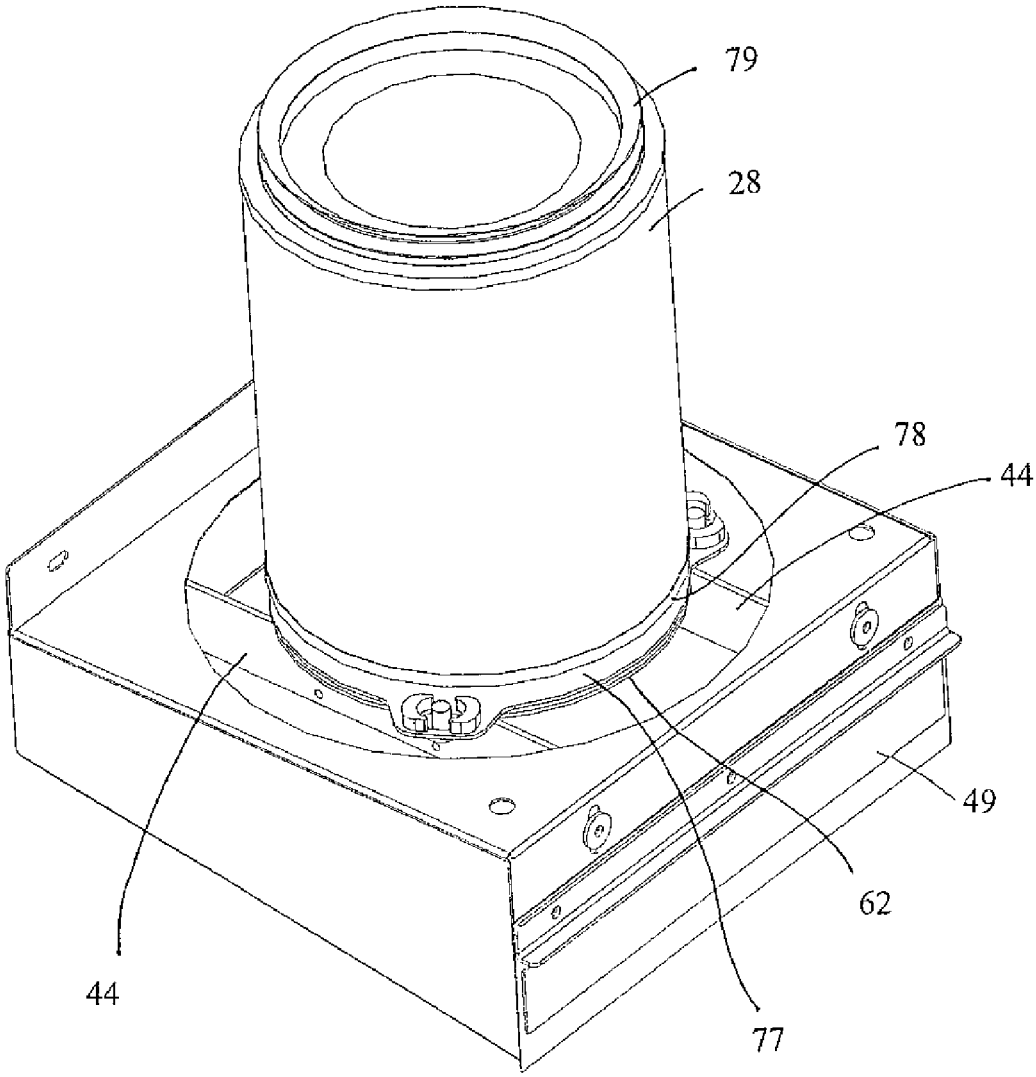
FIG. 10 is a perspective view of a filter and filter shaker components of the embodiment of FIG. 2.

FIG. 10 illustrates cylindrical filter 28 and support frame 44. A flexible gasket 79 engages shaker plate 77 and another gasket 79 engages the underside of cover 25 (not shown) during operation. Together the gaskets 79 seal the interior of filter 28 and prevent air leakage around filter 28. Filter support 78 controls the position of filter 28 relative to shaker plate 77 and thus limits the degree of gasket 79 compression.

Figure 11:
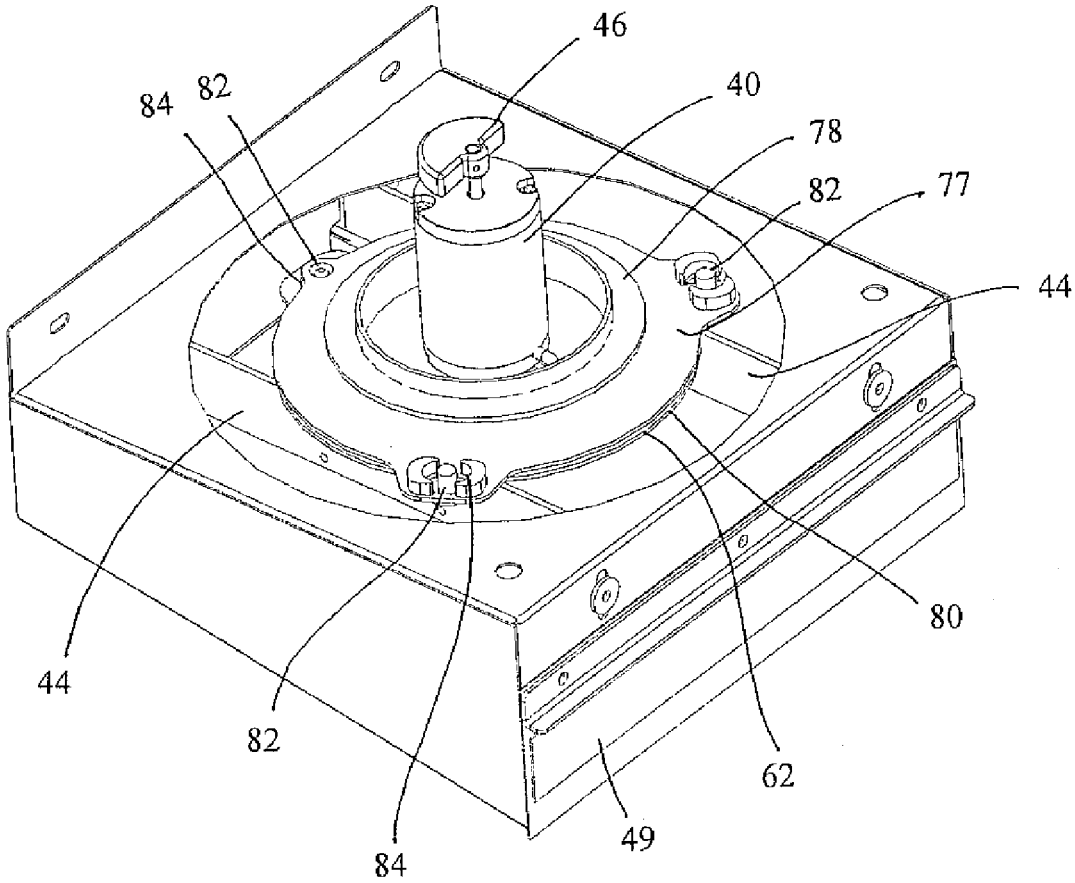
FIG. 11 is a perspective view of a filter and filter shaker components of the embodiment of FIG. 2.
Figure 12:
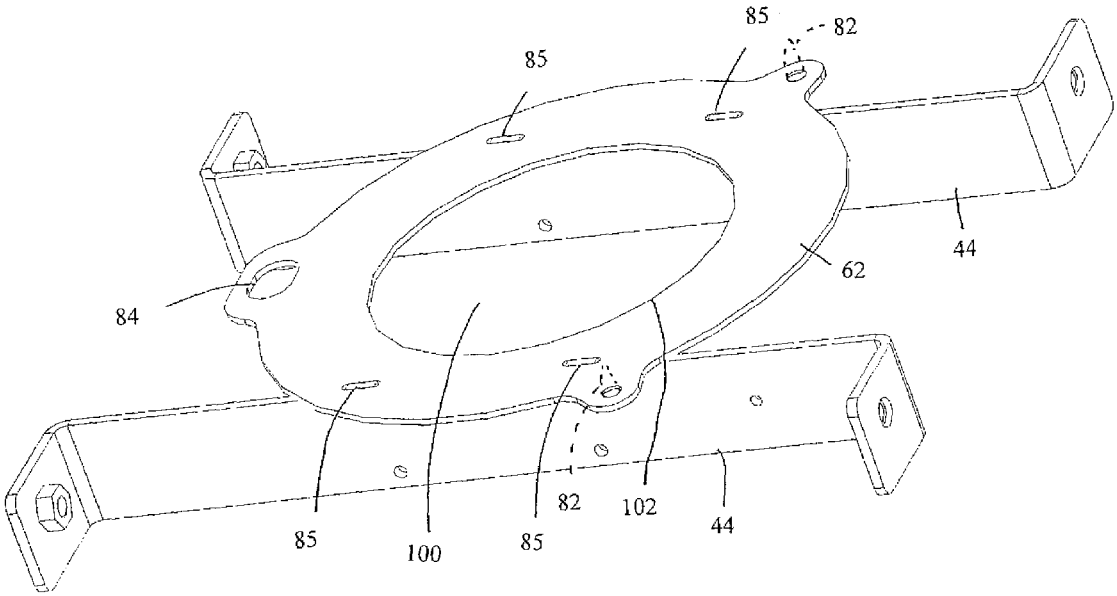
FIG. 12 is a perspective view of a filter shaker frame of the embodiment of FIG. 2.
Figure 13:
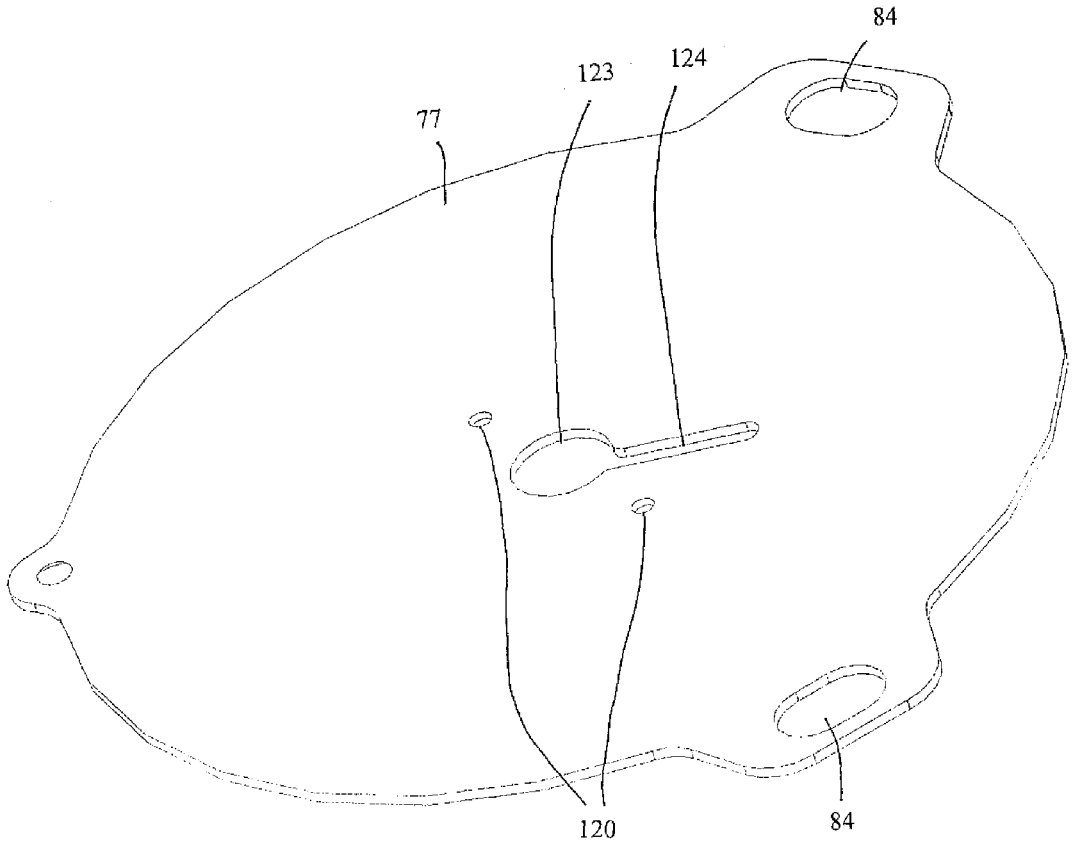
FIG. 13 is a perspective view of the shaker plate of FIG. 2.

FIG. 11 is a perspective view of components of the filter support frame and shaker mechanism. Shaker plate 77 is supported upon a slide bearing 80, which is supported upon support plate 62. During shaker mechanism operation, shaker plate 77 slides upon bearing 80 in response to movement of eccentric masses 46, 48. The rotational range of motion of shaker plate 77 is limited by pins 82 attached to the frame base plate 62. Pins 82 may engage edges of apertures 84 during motor 40 start up or during machine operation to prevent further rotation of shaker plate 77. Reinforcement structure, in this example welded stops, are provided around apertures 84 to minimize wear to shaker plate 77, base plate 62 and/or pins 82. Together the pins 82 and apertures 84 cooperate to limit the rotational range of motion of shaker plate 77 relative to the filter support frame 44. In the illustrated embodiment as shown in FIG. 12, a pair of pins 82 are connected to base plate 62. A third pin 82 is connected to shaker plate 77. As shown in FIG. 13, a pair of slot apertures 84 are defined on shaker plate 77 and a third slot aperture 84 is defined on base plate 62. This arrangement of pins 82 and apertures 84 prevents the shaker assembly from being assembled improperly during manufacturing or use.

FIG. 12 is a perspective view of frame support arms of the filter support frame 44 and base plate 62. In a preferred embodiment, tabs and slots 85 are defined in frame support arms of the filter support frame 44 and base plate 62 to aid in alignment, durability and/or manufacturability of the filter support frame 44. Base plate 62 includes a center aperture 100 defined by a circular edge 102.

FIG. 13 is a perspective view of shaker plate 77. Apertures 120 receive fasteners to secure electric motor 40 to shaker plate 77. Wiring for electric motor 40 passes through aperture 124. Motor shaft 74 passes through aperture 123.

Figure 14:
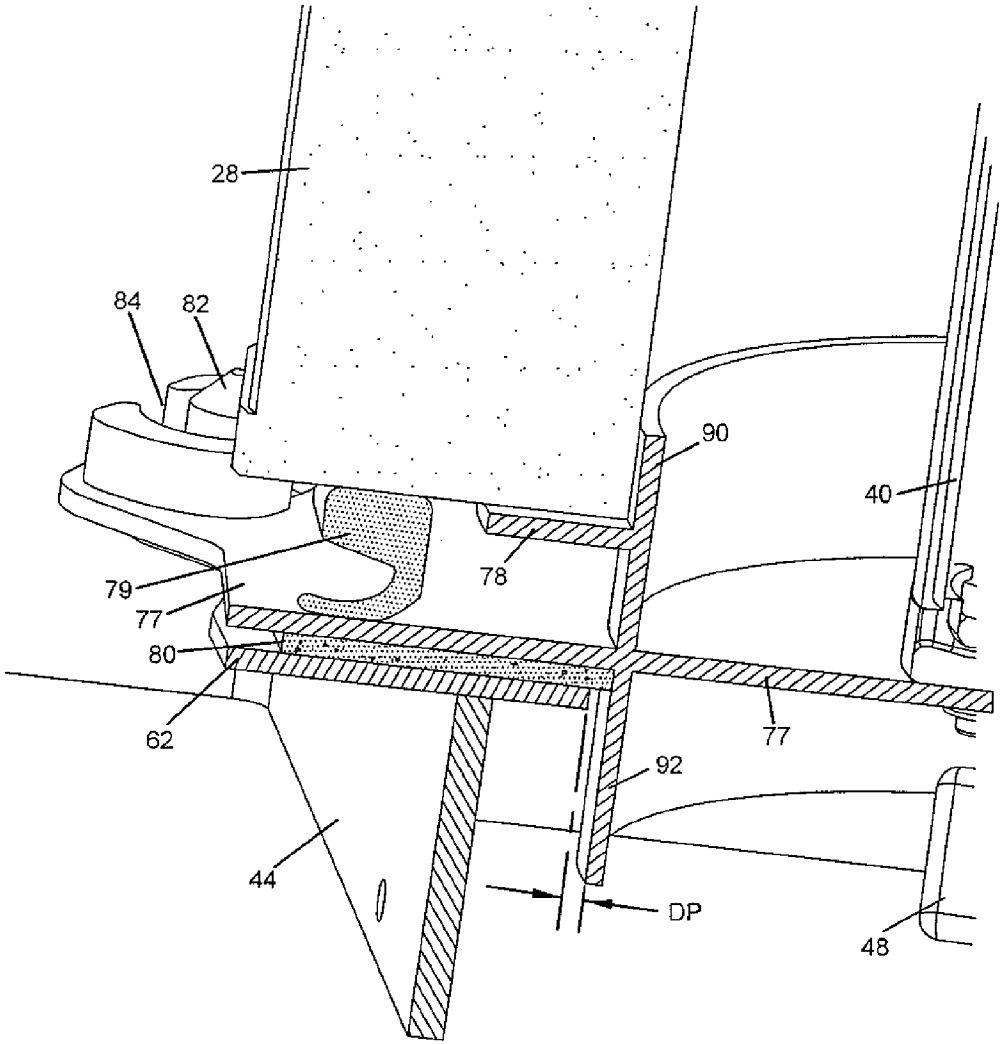
FIG. 14 is a detailed cross sectional view of the filter and filter shaker components of the embodiment of FIG. 2.
Figure 15:
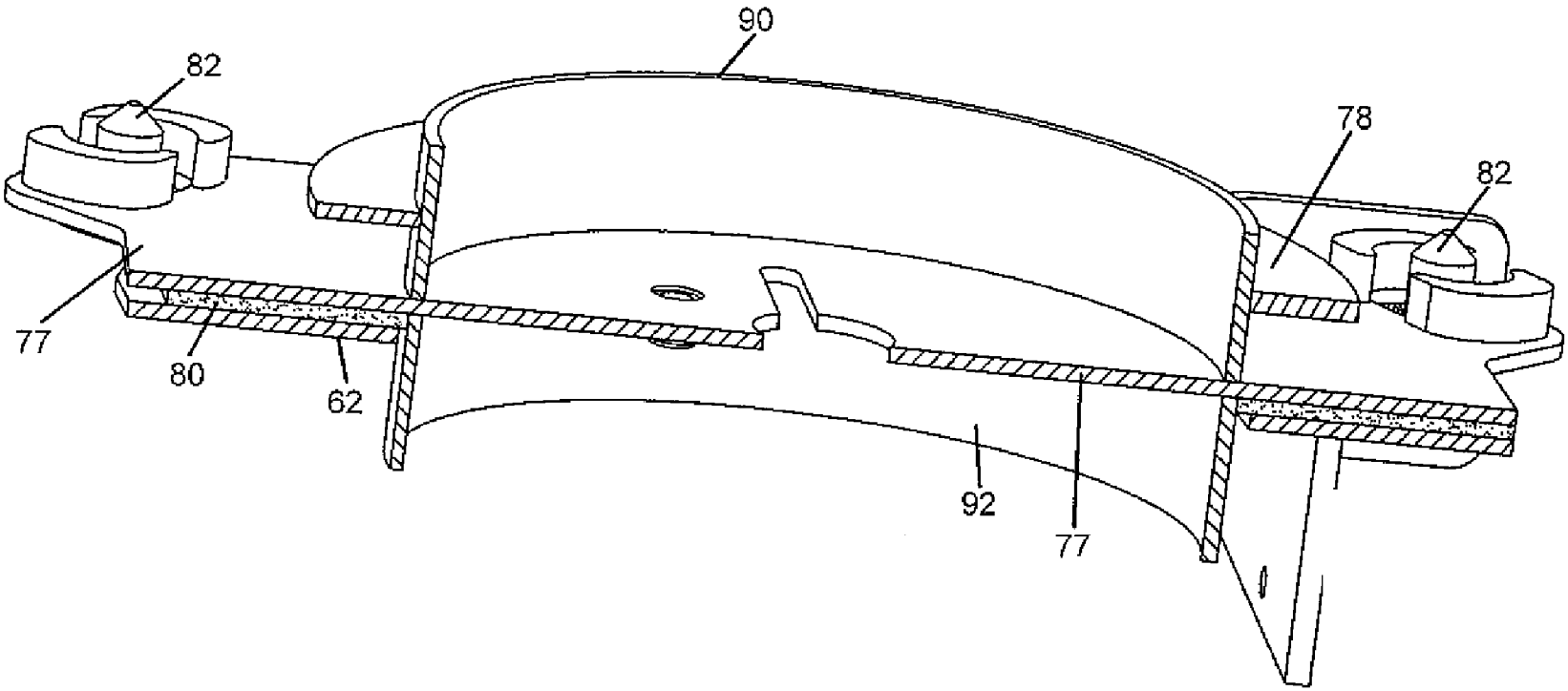
FIG. 15 is a detailed cross sectional view of the filter and filter shaker components of the embodiment of FIG. 2.

FIGS. 14-15 are cross sectional views of the shaker mechanism components and filter 28. The shaker mechanism includes a pair of cylindrical rings 90, 92 which are secured to shaker plate 77. Cylindrical ring 90 is sized in relation to the inside diameter of filter 28 so as to snuggly engage and retain filter 28 against shaker plate 77. Cylindrical ring 92 is sized in relation to the diameter of center aperture 100 of base plate 62. The size difference (or clearance) between ring 92 and aperture 100 is shown by dimension, DP. Ring 92 has a smaller diameter than that of aperture 100 so that shaker plate 77 can slide/rotate relative to base plate 62. During operation, ring 92 may contact the edge 102 of aperture 100 so as to limit the range of shaker motion. In a preferred embodiment, ring 92 is sized relative to aperture 100 so as to provide sufficient movement of shaker plate 77 in order to generate impulses upon contact between ring 92 and edge 102. In other embodiments, ring 92 may engage a differently configured structure of support plate 62. For example, edge 102 include additional support material provide additional durability. As a result, ring 92 and aperture 100 cooperate to limit the range of motion of shaker plate 77 relative to the filter support frame.

The control of filter shaker mechanism is via an on-board controller of machine 10. The controller may automatically activate the electric motor 40 of the shaker mechanism after a period of time has elapsed or upon receipt of a signal from a pressure switch indicating that the filter has become occluded. A differential pressure sensor/switch may be used across filter 28 to detect filter condition. As dust gradually accumulates on filter 28, the differential pressure will rise. When it reaches a predetermined value the pressure switch will close, which will initiate an automatic filter cleaning cycle. The time period during which electric motor 40 is activated may be predetermined. Alternatively, activation of the electric motor 40 to perform a filter shake procedure may be via a manual switch utilized by a machine operator.

Figure 16:
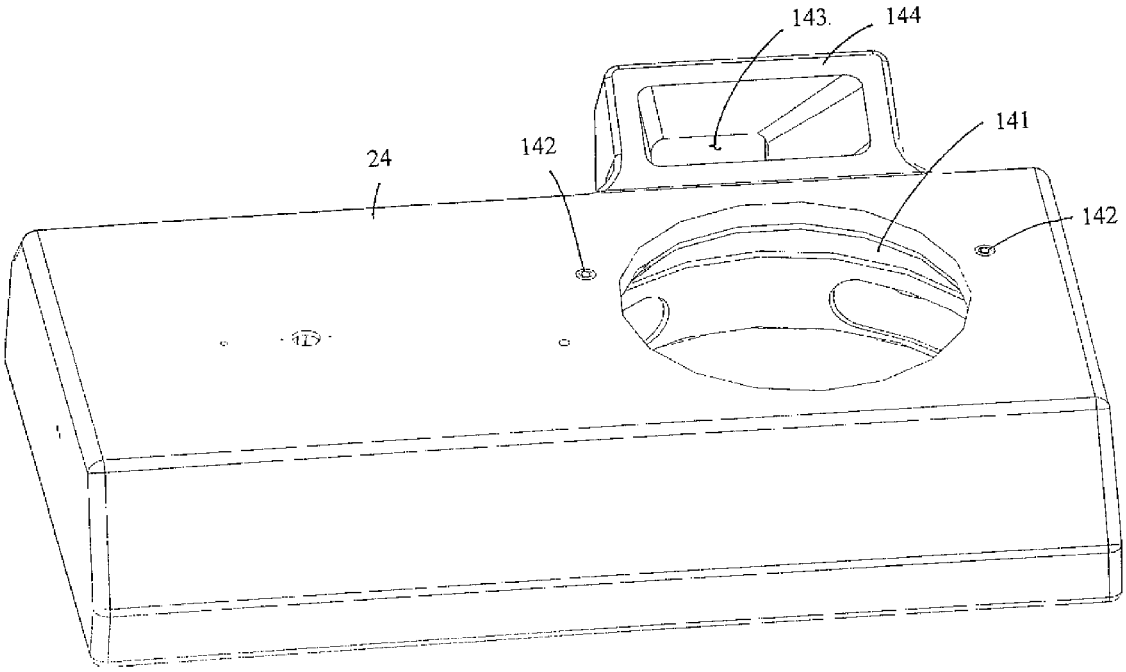
FIG. 16 is a top view of the main cover of the embodiment of FIG. 2.

FIG. 16 is a top perspective view of main cover 24 showing filter opening 141 through which filter 28 can be accessed during inspection, replacement, etc. The filter cover 25 (not shown) is secured to main cover 24 by threaded fasteners (not shown) engaging threaded components 142. Main cover 24 defines an air conduit 143 through which filtered air travels toward vacuum fan 16. Conduit 143 includes a mating surface 144 which is sealed against a surface of filter cover 25.

Figure 17:
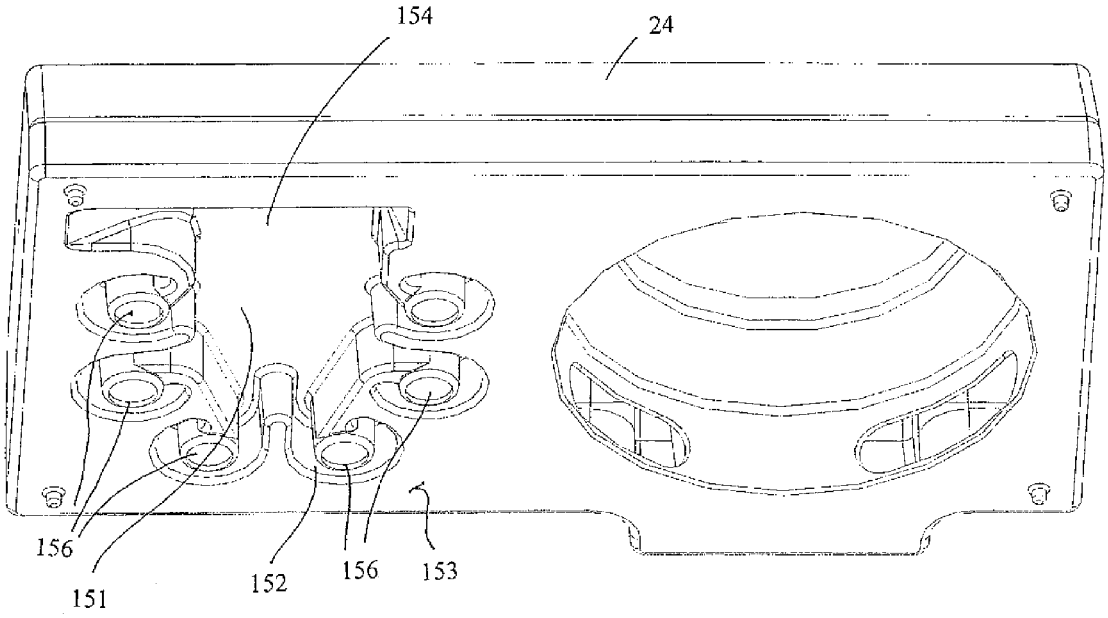
FIG. 17 is a bottom view of the main cover of the embodiment of FIG. 2.

FIG. 17 is a bottom perspective view of main cover 24 showing a plenum portion 151 connected to a plurality of vortex-forming spiral walls 152. Some of the walls 152 spiral in one direction and other walls 152 spiral in an opposite direction. A lower surface 153 of main cover 24 engages tray 26 (shown in FIG. 4) of the filter assembly. Dusty air from the hopper assembly enters plenum 151 at plenum entrance 154. Plenum 151 effectively distributes airflow across the various spiral walls 152 so as to maintain a balanced dust removal among the vortex separators. Air exits this portion of main cover 24 through openings 156 and passes into a generally enclosed volume of cover 24.

Advantages of a shaker mechanism in accordance with the present invention include: a cleaner operating environment for shaker motor 40 as motor 40 is position inside cylindrical filter 28; the pair of eccentric masses 46, 48 tend to provide a balanced, radial shaking motion to filter 28; filter 28 durability may be improved by providing a balanced, radial shaking motion; and noise generated during shaker mechanism operation can be minimized by providing a balanced shaker assembly.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A floor surface maintenance machine comprising:

a mobile chassis having a sweeping brush;

a hopper assembly for receiving debris thrown by the sweeping brush;

a vacuum fan; and a filter assembly in fluid communication with the hopper assembly, said filter assembly including a cylindrical filter having a hollow interior, a pair of open ends, and a generally cylindrical filter surface, with an air flow being established through the filter surface and out one of the pair of open ends of the cylindrical filter by the vacuum fan, a shaker plate engaging the other end of the cylindrical filter, a gasket between the shaker plate and the cylindrical filter, together the gasket and shaker plate preventing an airflow through the other end of the cylindrical filter;

a support frame supporting the shaker plate, and a filter shaking mechanism, said filter shaking mechanism including a motor attached to the shaker plate and being positioned at least partially within the hollow interior of the filter and an eccentric mass coupled to a shaft of the motor, said eccentric mass being rotated to remove debris from the filter surface, wherein a filter support is connected to and spaced from the shaker plate to limit a degree of compression applied to the gasket positioned between the cylindrical filter and the shaker plate.

2. The floor surface maintenance machine of claim 1 wherein said eccentric mass includes a pair of eccentric masses coupled along said motor shaft.

3. The floor surface maintenance machine of claim 2 wherein one of the pair of masses is positioned within the hollow interior of the filter and the other of the pair of masses is positioned on a side of the shaker plate opposite the filter.

4. The floor surface maintenance machine of claim 1 wherein the shaker plate includes a lower ring on a side of the shaker plate opposite the filter support, and the support frame includes a circular aperture having a diameter slightly larger than a diameter of the ring, wherein activation of the electric motor causes the lower ring to move toward contact with an edge of the circular aperture and generate a plurality of impulses upon contact between the ring and an edge of the circular aperture.

5. The floor surface maintenance machine of claim 1 wherein a bearing is positioned between the support frame and the shaker plate, said bearing allowing the shaker plate to move relative to the support frame.

6. The floor surface maintenance machine of claim 5 wherein at least one pin is attached to the shaker plate or the support frame or both, with said at least one pin engaging at least one aperture to limit the degree of movement between the shaker plate and the support frame.

7. A floor surface maintenance machine comprising:

a mobile chassis having a vacuum fan;

a debris hopper for receiving debris from a floor surface; and a filter assembly in fluid communication with the debris hopper and including a cylindrical filter, said filter having a pair of open ends, with one of the pair of open ends being held against a shaker that is slidably supported in a support frame attached within said debris hopper plate, with at least one gasket between the filter and the shaker plate to seal off said one of the pair of open ends of the filter, said vacuum fan drawing air through a surface of the filter and out the other of the pair of open ends of the filter, said shaker plate being vibrated by a motor connected to the shaker plate and at least partially positioned within an interior of the filter and at least one eccentric mass connected to the motor to remove an accumulation of debris from the surface of the filter, and wherein the support frame includes a base plate having a circular aperture, wherein a ring attached to the shaker plate on a side opposite the filter is received into said circular aperture, together said ring and circular aperture limiting a range of motion for the shaker plate relative to the support frame.

8. The floor surface maintenance machine of claim 7 wherein a bearing is provided between the shaker plate and the support frame, said bearing allowing the shaker plate to move relative to the support frame during a filter cleaning operation.

9. The floor surface maintenance machine of claim 7 wherein the shaker plate includes a filter support to control a degree of compression of said gasket.

10. A floor surface maintenance machine comprising:

a vacuum fan;

a cylindrical filter in fluid communication with the vacuum fan, said filter having a hollow interior and a pair of open ends;

a shaker plate and gasket engaging and sealing off one of the pair of open ends, with the vacuum fan drawing air through the filter and out the other of the pair of open ends;

an electric motor attached to the shaker plate; and a first eccentric mass attached to the electric motor, with said electric motor and first eccentric mass both being at least partially positioned within the hollow interior of the filter, and a second eccentric mass coupled along said motor shaft and positioned on a side of the shaker plate opposite the filter, and with activation of the electric motor causing the eccentric masses to rotate and vibrate the cylindrical filter to dislodge an accumulation of debris from a surface of the cylindrical filter.

11. The floor surface maintenance machine of claim 10 wherein the shaker plate is slidably supported upon a support frame, said support frame allowing the shaker plate to move relative to the support frame during a filter shaking procedure.

12. The floor surface maintenance machine of claim 11 wherein the shaker plate includes a filter support for controlling the position of the cylindrical filter relative to the shaker plate.

13. The floor surface maintenance machine of claim 12 wherein the shaker plate includes a lower ring on a side of the shaker plate opposite the filter support, and the support frame includes a circular aperture having a diameter slightly larger than a diameter of the ring, wherein activation of the electric motor causes the lower ring to move toward an edge of the circular aperture and generate an impulse upon contact between the ring and an edge of the circular aperture.

* * * * *

UNITED STATES PATENT AND TRADEMARK OFFICE

CERTIFICATE OF CORRECTION

PATENT NO. : 8,256,061 B2
APPLICATION NO. : 12/396398
DATED : September 4, 2012
INVENTOR(S) : Wilmo et al.

It is certified that error appears in the above-identified patent and that said Letters Patent is hereby corrected as shown below:

In claim 7, line 8, after “shaker” insert --plate-- therefor.

In claim 7, line 9, after “hopper” delete “plate”.

Signed and Sealed this
Thirteenth Day of November, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,256,061 B2
APPLICATION NO. : 12/396398
DATED : September 4, 2012
INVENTOR(S) : Wilmo et al.

It is certified that error appears in the above-identified patent and that said Letters Patent is hereby corrected as shown below:

Column 7, line 18 (claim 7, line 8) after “shaker” insert --plate-- therefor.

Column 7, line 19 (claim 7, line 9) after “hopper” delete “plate”.

This certificate supersedes the Certificate of Correction issued November 13, 2012.

Signed and Sealed this
Eleventh Day of December, 2012

David J. Kappos

David J. Kappos
*Director of the United States Patent and Trademark Office*